US006406769B1

(12) United States Patent
Delabre

(10) Patent No.: US 6,406,769 B1
(45) Date of Patent: Jun. 18, 2002

(54) WATCH CRYSTAL INCLUDING A LENS AND MANUFACTURING METHOD FOR SUCH A LENS

(75) Inventor: Guy Delabre, Portalban (CH)

(73) Assignee: Comadur S.A., Le Locle (CH)

( * ) Notice: Subject to any disclaimer, the term of this patent is extended or adjusted under 35 U.S.C. 154(b) by 0 days.

(21) Appl. No.: 09/275,403

(22) Filed: Mar. 24, 1999

(30) Foreign Application Priority Data

Apr. 2, 1998 (EP) ..... 98106048

(51) Int. Cl.[7] ..... G04B 39/00

(52) U.S. Cl. ..... 428/64.1; 368/276; 368/280; 368/296; 428/66.5; 428/66.7

(58) Field of Search ..... 428/64.1, 66.5, 428/66.7; 368/276, 280, 296

(56) References Cited

U.S. PATENT DOCUMENTS

| | | | | |
|---|---|---|---|---|
| 3,585,794 A | | 6/1971 | Klingenberg | 58/88 W |
| 4,043,116 A | * | 8/1977 | Schlappi | 58/88 |
| 5,230,182 A | | 7/1993 | Daniell et al. | 51/59 SS |
| 6,116,774 A | * | 9/2000 | Sasaki | 368/280 |

FOREIGN PATENT DOCUMENTS

| | | |
|---|---|---|
| CH | 368 756 | 12/1962 |
| CH | 495 003 | 1/1970 |
| EP | 0 123 891 | 11/1984 |
| EP | 0 814 388 A1 | 12/1997 |
| FR | 2 007 577 | 1/1970 |

OTHER PUBLICATIONS

Patent Abstracts of Japan, vol. 11, No. 50 (M–562), Feb. 17, 1987 & JP 61 214959 A (Canon Inc.), Sep. 24, 1986, Abstract.

* cited by examiner

*Primary Examiner*—Nasser Ahmad
(74) *Attorney, Agent, or Firm*—Griffin & Szipl, P.C.

(57) ABSTRACT

The invention concerns a watch crystal (1) made of hard mineral material, in particular a crystalline material such as corundum, sapphire or spinel, including a non-circular optical lens (4) shaped in the thickness of the material of the crystal. The lens is formed by machining and polishing a recess (5) preferably situated in the lower face (3) of the crystal. Its contour can have reentering angles, and can be for example rectangular. The machining is effected by means of a brush which hits the bottom of the recess with the addition of a polishing medium.

8 Claims, 1 Drawing Sheet

WATCH CRYSTAL INCLUDING A LENS AND MANUFACTURING METHOD FOR SUCH A LENS

FIELD OF THE INVENTION

The present invention concerns a watch crystal including an optical lens shaped in the thickness of the material of the crystal, as well as a manufacturing method for such a lens.

BACKGROUND OF THE INVENTION

Making a magnifying lens on a watch crystal in order to facilitate reading of a small portion of the display means of the watch, for example a date indicator in a window, is well known. According to a common embodiment, the lens projects on the upper face or the lower face of the crystal, the lens being able to have any shape. The lens can then be made integral with the crystal if the latter is manufactured by moulding, for example of a synthetic material such as PMMA. But if the crystal is made of a hard material such as sapphire, which is difficult to machine and polish, a projecting lens of this type is generally manufactured separately, then bonded onto the crystal. This presents assembly difficulties and the risk of the lens becoming detached with use. Moreover, projecting lenses are exposed to wear and to shocks if they are on the outer face of the crystal, or they represent an inconvenient bulk as regards the hands of the watch if they are on the inner face.

This has led to making lenses arranged in the thickness of the crystal, preferably in the lower face in order to avoid dirt being deposited along the edge thereof. European Patent No. 0 123 891 discloses a method for forming such a lens in a plate made of a mineral material, in particular sapphire, by machining by means of a rotating grinding wheel with an oscillating movement of the wheel or the plate. In practice, this method is only suitable for manufacturing circular lenses.

Another construction, disclosed in the European Patent Publication No. 0 814 388 A, consists in manufacturing separately the lens and the plate intended to form the crystal, arranging in the thickness of the plate a blind recess having a depth substantially equal to the thickness of the lens, then fixing the lens in this recess. The plate and the lens can in particular be made of glass, spinel, corundum or sapphire. This offers the advantage of allowing the lens a non-circular shape, for example an elongated shape to facilitate reading of an indication in a rectangular window. However, the manufacturing method remains quite complicated, in particular because the recess has to be machined and polished as well as the two faces of the lens, and the risk of the lens becoming detached remains.

SUMMARY OF THE INVENTION

An object of the present invention is to avoid the aforementioned drawbacks, in particular with crystals and lenses made of hard material, by providing a simple, resistant and attractive watch crystal.

A basic idea of the invention consists in making a watch crystal of corundum, sapphire or spinel, including an optical lens shaped in the thickness of the crystal material, this lens having a non-circular contour. In a preferred embodiment, the contour can have reentering angles and can for example be rectangular.

To our knowledge, the fact that such a watch crystal has not been made before results from the fact that one did not know how to manufacture it. Indeed, if a method had been found for machining a recess in a plate of hard material such as sapphire and one could envisage giving the bottom of this recess the convex shape of the lens, a mat surface would be obtained and it was not known how to polish it to give it the desired optical and aesthetic properties. This problem is resolved with the method which will be described hereinafter.

More particularly, another aspect of the invention concerns a manufacturing method for a non-circular optical lens in the thickness of a watch crystal made of a hard mineral material, in particular corundum, sapphire or spinel, characterised in that it includes the successive steps of forming by machining in one face of the crystal a recess of non-circular contour, the recess having lateral walls and a convex bottom intended to constitute a surface of the lens, and polishing at least the bottom of the recess by means of a brush having a reciprocating movement to hit the bottom, with the addition of a polishing medium.

The machining can be effected for example by ultrasound by means of a sonotrode, or by engraving by means of a rotating tool. In the polishing step, the brush can be animated, in addition to its back-and-forth movement, by a transverse movement, for example as a result of a rotation about an axis substantially perpendicular to the crystal and situated at a distance from the lens.

BRIEF DESCRIPTION OF THE DRAWINGS

Other features and advantages of the invention will appear in the following description of various preferred embodiments, with reference to the annexed drawings, in which.

DETAILED DESCRIPTION OF PREFERRED EMBODIMENTS

Figure 1:
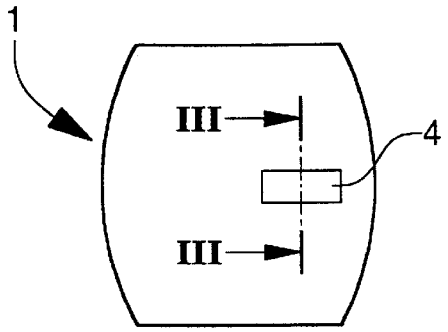
FIG. 1 shows the lower face of a watch crystal including a rectangular lens.
Figure 3:
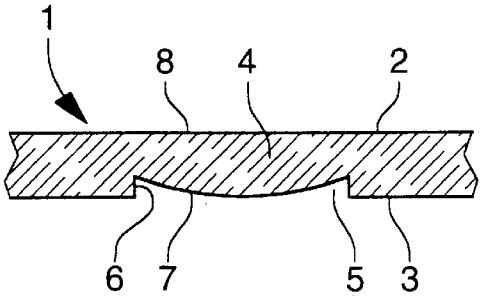
FIG. 3 is an enlarged cross-section of the crystal in the area of the lens, along the line III—III of FIG. 1.

The watch crystal 1 shown in FIGS. 1 and 3 is made of a hard transparent crystalline material of the corundum family, for example sapphire, or spinel. It can have any shape in plane, which is a <<barrel>> shape in the present case, as well as any shape in elevation, for example a flat or convex or faceted shape. FIG. 3 shows a case in which the upper face 2 and the lower face 3 of the crystal are flat. A rectangular converging lens 4 is made in the thickness of the material of crystal 1, its shape being determined by a recess 5 arranged in lower face 3 of the crystal. This recess has lateral walls 6 on its contour and a convex bottom 7 constituting the lower surface of lens 4. The upper surface 8 of the lens is directly formed by upper face 2 of the crystal.

In this example, lens 4 has a particularly elongated rectangular shape, allowing for example a date indicated in the form of the day of the week and the date to be read. Consequently, lower convex surface 7 of the lens will preferably have a cylindrical shape.

Figure 2:
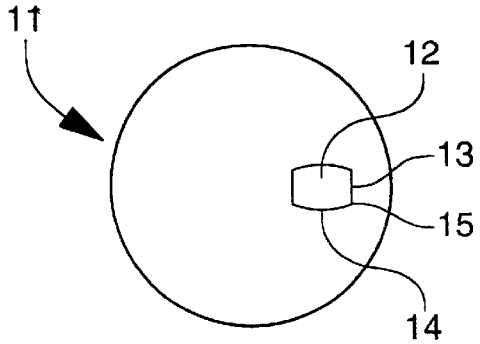
FIG. 2 shows the lower face of another watch crystal including a lens having another non-circular shape.

The present invention applies however to lenses having other non-circular peripheral shapes. FIG. 2 shows by way of example a crystal 11 in the thickness of which is formed a spherical lens 12 having any non-circular contour in plane, allowing particular aesthetic effects to be obtained. The contour of lens 12 can have in particular straight sides 13, curved sides 14 and reentering angles 15. The creator of the watch thus has greater freedom of choice.

Crystal 1 and its lens 4 can be manufactured in the following manner. Prior to forming the lens, crystal 1 can be manufactured by conventional methods of machining and polishing the material of which it is made. However, it will be noted that the polishing of its lower face can be effected at least in part after machining of the lens, i.e. at the same time as polishing of the convex bottom 7 of the lens.

Figure 4:
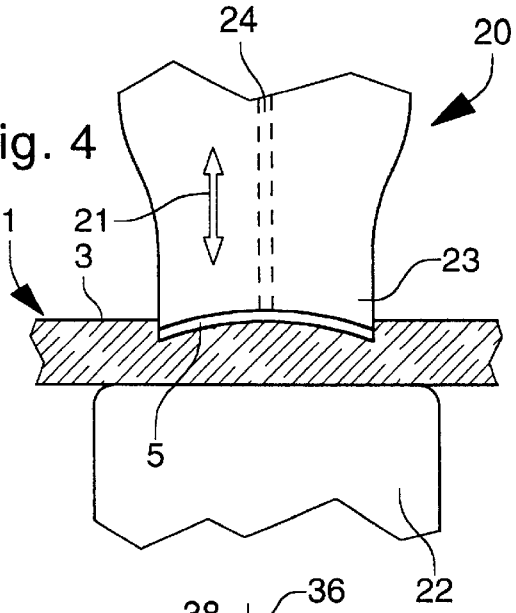
FIG. 4 is a schematic cross-section illustrating the ultrasound machining of the lens of FIG. 3.

Machining to shape lens 4 consists in digging recess 5 in face 3 of the crystal by any appropriate technique. In the case of a non-circular lens, in particular if the contour of the lens has reentering angles, a preferred technique is that of ultrasound machining by means of a sonotrode 20 such as shown in FIG. 4, the ultrasonic vibration being represented by the double arrow 21. Crystal 1 is placed upside down on an anvil 22. The end 23 of the sonotrode has a three-dimensional shape which corresponds to the desired final shape of recess 5. Preferably sonotrode 20 is diamond tipped and a liquid charged with diamond powder is also injected through conduits 24 to the end of the sonotrode. This machining produces a recess 5 whose surfaces are lustreless and whose lateral walls 6 are substantially perpendicular to face 3 of the crystal.

Another machining method which can be used to form recess 5 is that of engraving by means of a rotating tool such as diamond tipped milling cutter making a copy from a model. If the shape in plane of the recess has reentering angles, they will then be slightly rounded. Lateral walls 6 can be inclined in one direction or another with respect to the line perpendicular to face 3.

Figure 5:
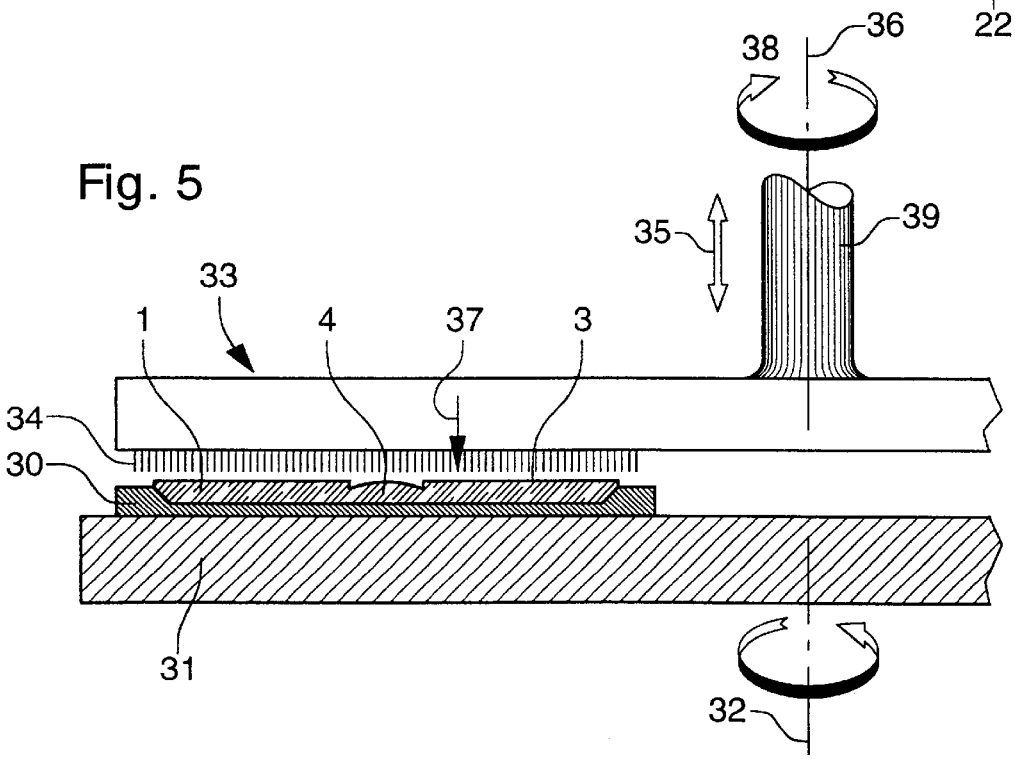
FIG. 5 is a schematic cross-section illustrating the polishing of the crystal and the lens of FIG. 3.

Convex surface 7 of the lens is then polished, as well as lateral walls 6 recess 5, by a technique called <<brushing-tapping>> illustrated in FIG. 5. Crystal 1 is placed upside down in a frame 30 supported by a horizontal rotating table 31 which rotates about an axis 32 situated at a distance from the crystal. In practice, several crystals 1 are distributed on table 31 to be polished at the same time. Above these crystals there is a large circular brush 33 whose bristles 34 are directed towards crystals 1. Brush 33 is fixed to a vertical shaft 39 having a reciprocating movement 35 parallel to its axis 36. As a result, the ends of bristles 34 hit both face 3 of the crystal, the bottom and the lateral walls of recess 5. At the same time as arrow 37 indicates, a polishing medium such as a paste or a liquid (in particular an oil or beeswax) charged with diamond powder is applied over the crystal, for example by injection through brush 33. The desired optical polish is thus obtained both on the lens and over the rest of the crystal.

Preferably, brush 33 also has a transverse movement facing each crystal, so that the bristles of the brush move with respect to the surfaces to be polished. In the present example, this movement is obtained simply by a rotation 38 about axis 36 of the brush, this axis being situated at a distance from the crystals and the lenses.

The method described hereinbefore is characterised by great simplicity, since the lens can be polished at the same time as the crystal, and it allows lens of any shape to be obtained, shaped in the material of the crystal itself. This method is particularly advantageous with respect to the manufacture of a crystal with an added lens according to European Patent No. 0 814 388, which required separate machining and polishing of the two faces of the crystal, the recess intended to receive the lens, and the two faces of the lens to be manufactured separately. It further avoids the problems linked to fitting the lens in its housing, bonding and the risk of detachment.

What is claimed is:

1. A watch crystal made of a material selected from the group consisting of corundum, sapphire or spinel, including an optical lens shaped in the thickness of the material of the crystal, wherein the lens has a non-circular contour in plane.

2. A watch crystal according to claim 1, wherein said contour has reentering angles.

3. A watch crystal according to claim 1, wherein said contour is rectangular.

4. A watch crystal according to claim 1, wherein one of the surfaces of the lens is formed by a face of the crystal and wherein the other surface of the lens, arranged in the other face of the crystal, has a spherical or cylindrical shape.

5. A watch crystal consisting of corundum, sapphire or spinel, including an optical lens shaped in the thickness of the material of the crystal, wherein the lens has a non-circular contour in plane.

6. A watch crystal according to claim 5, wherein said contour has reentering angles.

7. A watch crystal according to claim 5, wherein said contour is rectangular.

8. A watch crystal according to claim 5, wherein one of the surfaces of the lens is formed by a face of the crystal and wherein the other surface of the lens, arranged in the other face of the crystal, has a spherical or cylindrical shape.

* * * * *